US010367294B1

(12) United States Patent
Smith et al.

(10) Patent No.: US 10,367,294 B1
(45) Date of Patent: Jul. 30, 2019

(54) ELECTRICAL DEVICE HAVING A GROUND TERMINATION COMPONENT WITH STRAIN RELIEF

(71) Applicant: TE CONNECTIVITY CORPORATION, Berwyn, PA (US)

(72) Inventors: Tracy Lee Smith, Harrisburg, PA (US); Kevin Stauffer, Lancaster, PA (US); Emilio Cuesta, Middletown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/915,282

(22) Filed: Mar. 8, 2018

(51) Int. Cl.
*H01R 13/58* (2006.01)
*H01R 13/6592* (2011.01)
*H01R 13/6596* (2011.01)

(52) U.S. Cl.
CPC ..... *H01R 13/5808* (2013.01); *H01R 13/6592* (2013.01); *H01R 13/6596* (2013.01)

(58) Field of Classification Search
CPC ..... H01R 23/662; H01R 13/6585; H01R 13/6592; H01R 13/6596; H01R 13/5808; H05K 1/0245
See application file for complete search history.

(56) References Cited

U.S. PATENT DOCUMENTS 4,875,877 A 10/1989 Fleak et al.
5,122,065 A 6/1992 Dudek et al.
6,074,251 A * 6/2000 Edgerly ..... H04Q 1/116 439/479
6,428,344 B1 * 8/2002 Reed ..... H01R 9/05 439/455
7,435,132 B1 * 10/2008 Fong ..... H01R 9/038 439/497
8,632,357 B2 1/2014 Straka et al.
9,124,009 B2 * 9/2015 Atkinson ..... H01R 13/6464
9,203,193 B2 12/2015 Hackman et al.
9,545,040 B2 1/2017 Garman et al.
10,170,862 B2 1/2019 Weidner et al.
2003/0073331 A1 * 4/2003 Peloza ..... H01R 13/6473 439/108
2005/0176300 A1 * 8/2005 Hsu ..... H01R 9/034 439/98
2010/0210142 A1 * 8/2010 McGrath ..... H01R 12/594 439/620.22
2011/0306244 A1 * 12/2011 Zhang ..... H01R 9/034 439/624

(Continued)

*Primary Examiner* — Briggitte R. Hammond

(57) ABSTRACT

An electrical device includes a substrate having a plurality of signal contacts and a ground contact along a surface of the substrate. A communication cable includes a differential pair of signal conductors, a grounding element that surrounds the signal conductors, and a cable jacket surrounding the signal conductors and the grounding element. Each of the signal conductors has a wire-terminating end that is terminated to a corresponding signal contact of the substrate, the wire-terminating end projecting beyond a jacket edge of the cable jacket. A ground termination component has a main panel electrically coupled with the ground contact, and a strain relief element engaged with at least a portion of the communication cable. The strain relief element includes a connective terminal electrically coupled to the grounding element.

20 Claims, 2 Drawing Sheets

(56) References Cited

U.S. PATENT DOCUMENTS

| | | | | |
|---|---|---|---|---|
| 2012/0052699 | A1* | 3/2012 | MacDougall ..... | H01R 9/035<br>439/55 |
| 2013/0072041 | A1* | 3/2013 | Nonen ..... | H01R 9/035<br>439/98 |
| 2017/0294721 | A1 | 10/2017 | Pao et al. | |

* cited by examiner

ELECTRICAL DEVICE HAVING A GROUND TERMINATION COMPONENT WITH STRAIN RELIEF

BACKGROUND OF THE INVENTION

The subject matter herein relates generally to an electrical device having a ground termination component with a strain relief element.

Communication cables electrically couple to various types of electrical devices to transmit differential signals, such as connectors and circuit boards. In some applications, such as high-speed data transmission applications, electromagnetic interference (EMI) and/or radio frequency interference (RFI) are concerns. So, the electrical cables are shielded to protect against interference from environmental sources of EMI/RFI. For example, some known communication cables include a differential pair of signal conductors surrounded by a shield layer that, in turn, is surrounded by a cable jacket. The shield layer includes a conductive foil, which functions to shield the signal conductor(s) from electromagnetic interference (EMI) and generally improve performance. In addition, the shield layer may function as a grounding element. At an end of the communication cable, the cable jacket, the shield layer, and insulation that covers the signal conductor(s) may be removed or stripped to expose the signal conductor(s) and/or the shield layer. The exposed portions of the conductor(s) and shield layer may then be mechanically and/or electrically coupled, such as soldering, to corresponding elements of an electrical device, such as signal contacts, ground contacts, ground busbars, and or substrates.

Coupling the communication cables to the various components of the electrical connector may be a time consuming and expensive process. For example, electrical connectors may have a substrate, such as a circuit board, with signal contacts for coupling with signal conductors of the communication cable, and a ground busbar with ground contacts for electrically coupling with grounding elements of the communication cable, such as the conductive foil shield layer or a drain wire, held by a housing. Furthermore, each component used in a connector requires additional tooling and assembly. Thus, communication cables and connectors that use less components and require less mechanical and electrical coupling reduce cost, tooling, and assembly time.

During assembly, the communication cables are subject to significant forces which may cause disconnection or damage at the connection points between the communication cables and the substrate. For example, the cables may be pulled on during routing of the cables within the system. Therefore, the connection points between the communication cables and the circuit board must be protected.

Accordingly, there is a need for an electrical device that includes a ground termination component with a strain relief element.

BRIEF DESCRIPTION OF THE INVENTION

In one embodiment, an electrical device is provided that includes a substrate having a plurality of signal contacts and a ground contact along a surface of the substrate. A communication cable includes a differential pair of signal conductors, a grounding element that surrounds the signal conductors, and a cable jacket surrounding the signal conductors and the grounding element. Each of the signal conductors has a wire-terminating end that is terminated to a corresponding signal contact of the substrate, the wire-terminating end projecting beyond a jacket edge of the cable jacket. A ground termination component has a main panel electrically coupled with the ground contact, and a strain relief element engaged with at least a portion of the communication cable. The strain relief element includes a connective terminal electrically coupled to the grounding element.

In another embodiment, an electrical device is provided having a substrate having a plurality of signal contacts and a ground contact along a surface of the substrate. A communication cable includes a differential pair of signal conductors, a grounding element that surrounds the signal conductors, and a cable jacket surrounding the signal conductors and grounding element. Each of the signal conductors has a wire-terminating end that is terminated to a corresponding signal contact of the substrate, the wire-terminating end projecting beyond a jacket edge of the cable jacket. The cable jacket has an access opening located a longitudinal distance from the jacket edge of the cable jacket. The electrical device also includes a ground termination component having a main panel electrically coupled with the ground contact, and a strain relief element engaged with at least a portion of the communication cable. The strain relief element includes a connective terminal electrically coupled to the grounding element through the access opening.

In yet another embodiment, an electrical device is provided having a substrate having a plurality of signal contacts and a ground contact along a surface of the substrate. A first communication cable includes a differential pair of signal conductors, a grounding element that surrounds the signal conductors, and a cable jacket surrounding the signal conductors and the grounding element. Each of the signal conductors has a wire-terminating end that is terminated to a corresponding signal contact of the substrate, the wire-terminating end projecting beyond a jacket edge of the cable jacket. A second communication cable includes a differential pair of signal conductors, a grounding element that surrounds the signal conductors, and a cable jacket surrounding the signal conductors and the grounding element. Each of the signal conductors has a wire-terminating end that is terminated to a corresponding signal contact of the substrate, the wire-terminating end projecting beyond a jacket edge of the cable jacket. The electrical device also includes a ground termination component electrically coupled with the ground contact and having a first strain relief element configured to engage with at least a portion of the first communication cable, and a second strain relief element configured to engage with at least a portion of the second communication cable. The first strain relief element includes a first connective terminal electrically coupled to the grounding element of the first communication cable, and the second strain relief element includes a second connective terminal electrically coupled to the grounding element of the second communication cable.

DETAILED DESCRIPTION OF THE INVENTION

Embodiments described herein include electrical devices that have electrical connectors, communication cables, and/or a ground termination component. For example, the communication cables may have one or more differential pairs of signal conductors electrically connected to the connectors and grounding elements, such as a conductive foil shield layer coupled with the ground termination component. The ground termination component may have a variety of configurations as set forth herein. For example, embodiments may include the ground termination component having a main panel and a strain relief element configured to engaged with at least a portion of the communication cables. The strain relief element may include a connective terminal that is electrically coupled to the grounding elements. Optionally, a solder material, such as a metal alloy material, may be deposited within the connective terminal and melted to mechanically and electrically couple the grounding element and the ground termination component. The ground termination component may have a variety of configurations as set forth herein.

Figure 1:
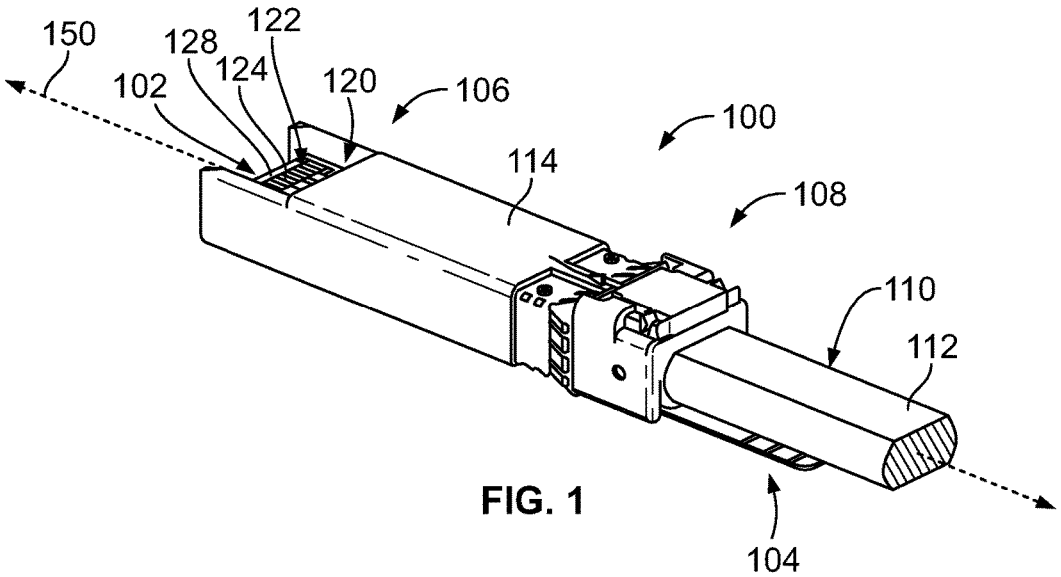
FIG. 1 is a perspective view of an electrical device formed in accordance with an embodiment.

FIG. 1 is a perspective view of an electrical device 100 formed in accordance with one embodiment that includes a substrate 122, such as a circuit board, and a communication cable 110 having one or more differential pairs of signal conductors and a grounding element (not shown). In the illustrated embodiment, the electrical device 100 is an electrical connector, such as a small form-factor pluggable (SFP) transceiver. However, the electrical device 100 may be another type of electrical connector in an alternative embodiment. For example, the electrical device 100 may be any device that includes a circuit board having differential pairs of signal conductors and a grounding element terminated thereto.

As shown in FIG. 1, the electrical device 100 has a mating end 102, a loading end 104, and a central axis 150 extending therebetween. The electrical device 100 may include a plug portion 106 at the mating end 102 and a cable portion 108 at the loading end 104. The plug portion 106 is configured to be inserted into a receptacle (not shown) of a communication system (not shown). The cable portion 108 is configured to couple to the communication cable 110 which has an insulative jacket 112. The insulative jacket 112 may surround the one or more differential pairs of signal conductors and the drain wire. The insulative jacket 112 may comprise a number of layers that surround the differential pairs for shielding the differential pairs and providing strain resistance for the communication cables. The layers may include, for example, polyvinyl chloride (PVC), copper braid, aluminized mylar, and/or tape.

The electrical device 100 includes a device housing 114 that has a housing cavity (not shown) configured to hold a portion of a connector assembly 120. The connector assembly 120 includes the substrate 122, which has electrical contacts 124 located at a mating edge 128 of the substrate 122, which is proximate to the mating end 102 of the electrical device 100. In an exemplary embodiment, the mating edge 128 is configured to mate with an electrical connector (not shown) of the receptacle and establish a communicative connection through the electrical contacts 124. The electrical contacts 124 may be communicatively coupled to the differential pairs of the signal conductors and a grounding element.

Figure 2:
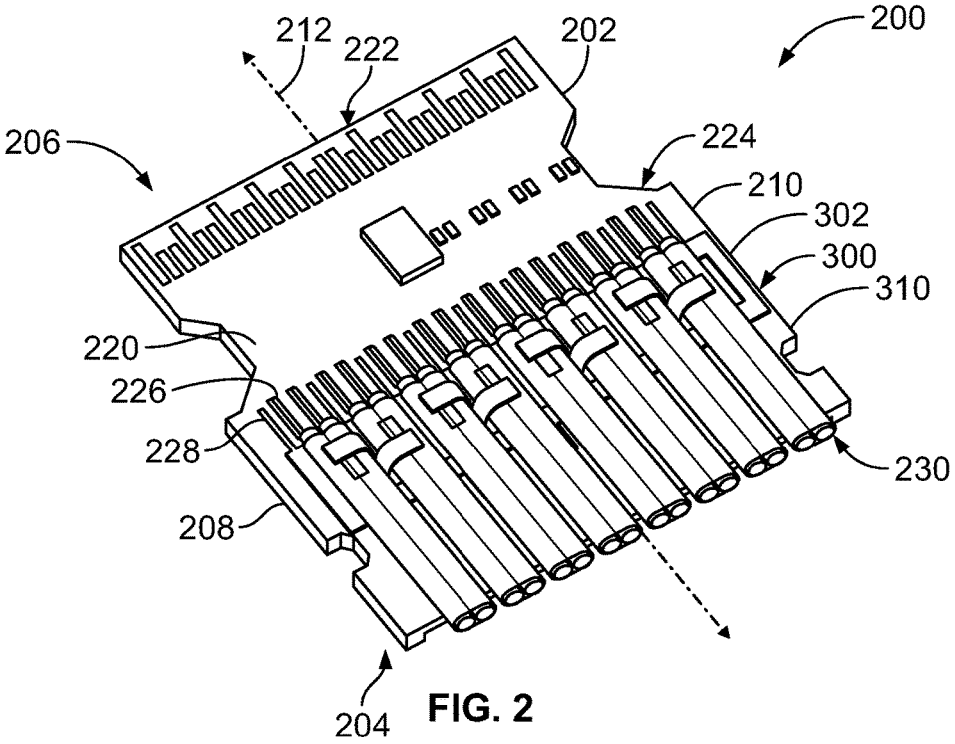
FIG. 2 is a perspective view of an electrical assembly according to one embodiment that may be used with the electrical device of FIG. 1.

FIG. 2 is a perspective view of an electrical assembly 200 according to one embodiment that may be used with the electrical device 100 of FIG. 1. The electrical assembly 200 may be used as the connector assembly 120 (FIG. 1) and may be disposed at least partially within the device housing 114 (FIG. 1). The electrical assembly 200 includes the substrate 202 having a terminating edge 204, a mating edge 206, and side edges 208, 210 that extend from the terminating edge 204 toward the mating edge 206 along a central axis 212. In the exemplary embodiment, the substrate 202 may be a printed circuit board, including a number of dielectric layers, traces, vias, defining ground and signal contacts.

The substrate 202 includes upper and lower board surfaces 220 that face in opposite directions although only the upper surface 220 is fully shown in FIG. 2. As shown, the upper board surface 220 includes electrical contacts 222 that are proximate to the terminating edge 204 and electrical contacts 224 that are proximate to the mating edge 206. In the illustrated embodiment, the electrical contacts 222, 224 are contact pads and may include signal contacts 226 and ground contacts 228. The electrical contacts 222, 224 may be communicatively coupled to one another through the substrate 202. For example, the traces (not shown) of the substrate 202 may communicatively couple the electrical contacts 222, 224 of the terminating edge 204 with the electrical contacts 222, 224 of the mating edge 206. Optionally, the lower board surface 220 may include electrical contacts similarly configured to the electrical contacts 222 of the upper board surface. For example, the lower board surface 220 may include signal and ground contacts communicatively coupled through traces of the substrate 202.

The electrical assembly 200 also includes a plurality of communication cables 230 that are electrically coupled to the substrate 202 along the upper board surface 220. Eight communication cables 230 are shown terminated to the upper board surface 220, however, alternate embodiments may include any number of communication cables 230. A ground termination component 300 electrically couples a grounding element 236 of the communication cables 230 and the electrical contacts 224 to create an electrical ground connection. The ground termination component 300 includes a plurality of strain relief elements 310 configured to engage with a portion of the corresponding communication cables 230 along an interface 302.

Figure 3:
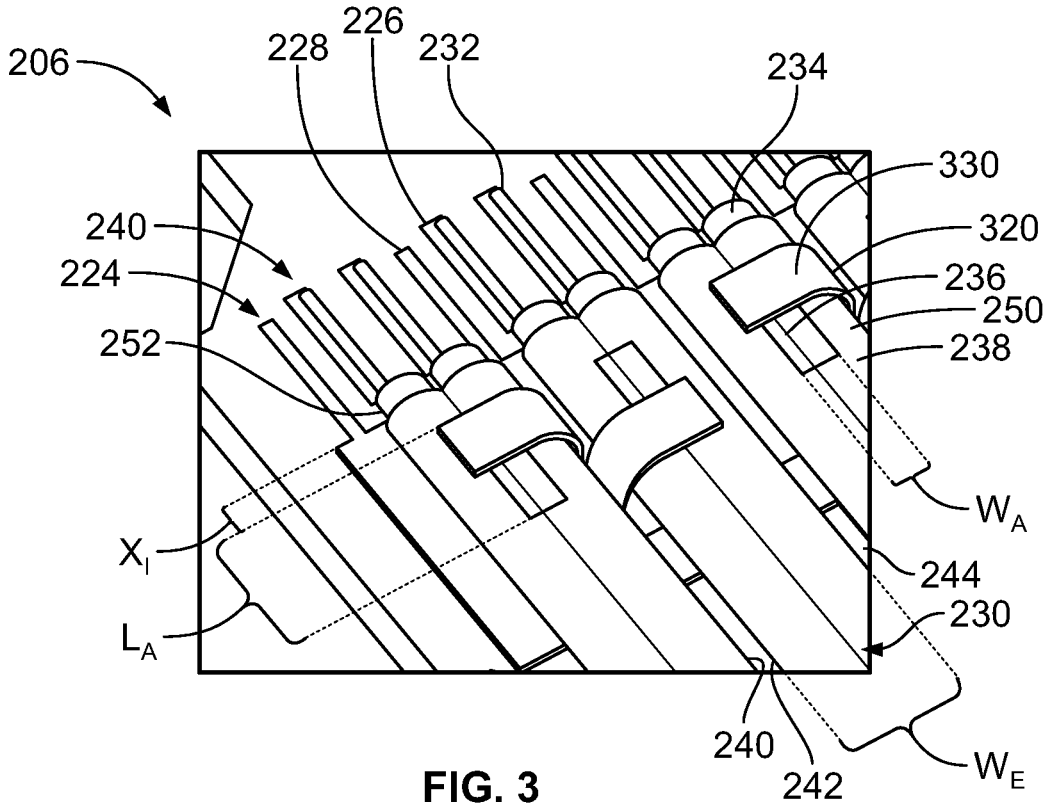
FIG. 3 is an enlarged perspective view of the electrical assembly according to one embodiment that may be used with the electrical device of FIG. 1.

FIG. 3 is an enlarged perspective view of the electrical assembly 200 according to one embodiment that may be used with the electrical device 100 of FIG. 1. In the exemplary embodiment, the communication cables 230 may be characterized as twin-axial or parallel-pair cables that include a differential pair of signal conductors 232 in which the two signal conductors 232 of a single differential pair extend parallel to each other through a length of the communication cable 230. The communication cables also include one or more insulators 234 surrounding the signal conductors 232, a grounding element 236, such as a shield layer, that peripherally surrounds the insulators 234 and the signal conductors 232 to provide electrical shielding, and an insulative jacket 238 that surrounds the grounding element 236. The grounding element 236 may include, for example, a conductive foil or tape composed of copper, aluminized mylar or other suitable material. The insulative jacket 238 may comprise a number of layers that surround the differential pairs for providing environmental protection for the communication cable 230. The layers may include, for example, polyvinyl chloride (PVC), copper braid, aluminized mylar, and/or tape. Optionally, a drain wire (not shown) also extends parallel with the signal conductors through the length of the communication cable 230.

As shown in FIG. 3, the communication cables 230 have had a portion of the jacket 238, grounding element 236, and insulators 234 stripped or removed therefrom to expose the signal conductors 232 and the grounding element 236. Exposed portions of the signal conductors 232 project beyond a jacket edge of the jacket 238, to define as wire-terminating ends 240 configured to be terminated to the signal contacts 226 of the electrical contacts 224. For example, the wire-terminating ends 240 may electrically connect to the electrical contacts 224 by laser termination, soldering, crimping, welding, using conductive adhesive, using insulation displacement contacts, and the like.

Although not shown, the communication cables 230 of FIGS. 2 and 3 may be part of a larger cable and may be surrounded by an external jacket or sleeve. The external jacket may be stripped to permit manipulation of the communication cables 230 as set forth herein. In alternative embodiments, the signal conductors within the communication cable 230 may form a twisted pair of signal conductors. In other various embodiments, the communication cable 230 may be a single-ended cable having a single central conductor rather than the pair of signal conductors.

For parallel-pair configurations, the communication cable 230 has opposite contoured sides 241, 242 and opposite planar sides 244 that extend between and join the contoured sides 241, 242. Only one planar side 244 is shown in FIG. 3, but it is understood that the communication cable 230 has another planar side 244 that is opposite the planar side 244. The contoured sides 241, 242 may have cross-sections taken transverse to a length of the communication cable 230 that have a semi-circle shape. The communication cable 230 has a width $W_C$.

As shown, the grounding element 236 is exposed through an access opening 250 of the cable jacket 238. The access opening 250 may be spaced from an end of the cable jacket 238. For example, the cable jacket 238 includes a jacket edge 252. The access opening 250 may be located a longitudinal distance $X_1$ away from the jacket edge 252 along a length of the communication cable 230. The access opening 250 extends a depth into the communication cable 230 from an exterior surface of the cable jacket 238 to the grounding element 236. The access opening 250 may be formed by, for example, using a laser (e.g., $CO_2$ laser) to etch the cable jacket 238 to remove the material of the cable jacket 238 and expose the grounding element 236. Accordingly, the access opening 250 may be a void along the grounding element 236. The access opening 250 may be partially defined by the material of the cable jacket 238 and the grounding element 236 (e.g., conductive foil). The access opening 250 may open to an exterior of the communication cable 230.

The access opening 250 may have a width $W_A$ and a length $L_A$. In the illustrated embodiment, the width $W_A$ is less than the width $W_C$ of the communication cable 230. The width $W_A$ may be sized such that the access opening 250 extends only along the planar side 244 and does not extend into the contoured sides 241, 242. However, the width $W_A$ may be larger in other embodiments such that portions of the contoured sides 241, 242 also have material from the cable jacket 238 removed. For example, the width $W_A$ may be substantially equal to the width $W_C$.

Figure 4:
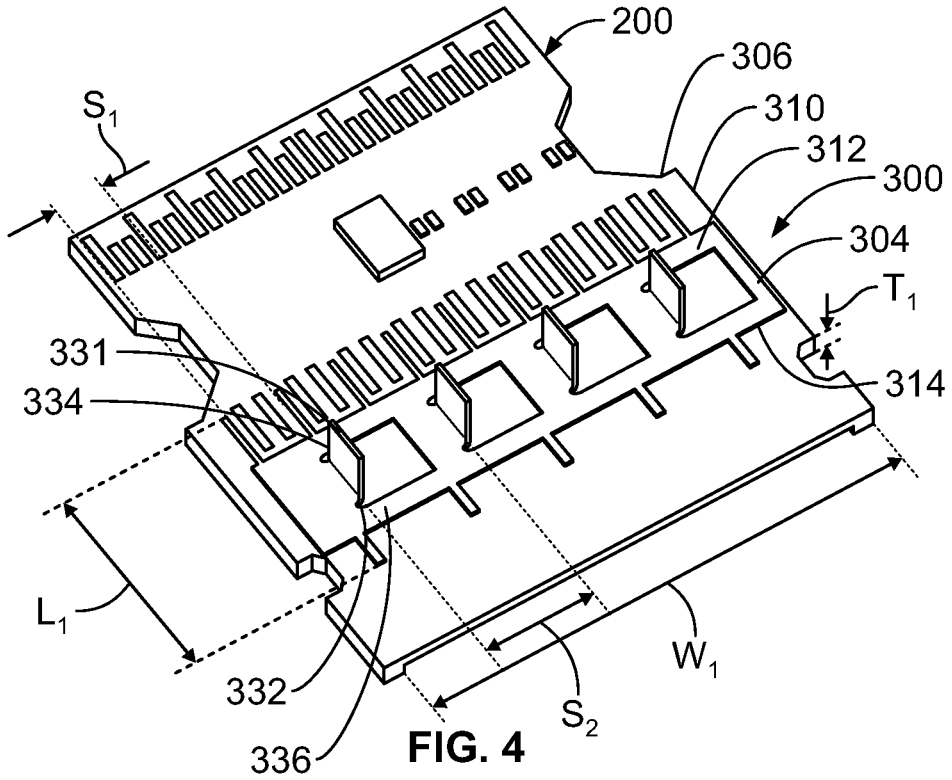
FIG. 4 is a perspective view of a substrate and a ground termination component of the electrical assembly in accordance with an embodiment.

FIG. 4 is a perspective view of the substrate 202 and the ground termination component 300 of the electrical assembly 200 in accordance with an embodiment. The communication cables 230 are not shown in FIG. 4 to better illustrate the ground termination component 300. In the exemplary embodiment, the ground termination component 300 includes a main panel 304 extending along the upper board surface 220 of the substrate 202. The main panel 304 has a substantially rectangular shape with a plurality of fingers 306 extending therefrom to electrically couple with the ground contacts 228 of the substrate 202. The ground termination component 300 has a length $L_1$, the width $W_1$, and a thickness $T_1$. The fingers 306 are distributed along a width $W_1$ of the ground termination component 300 by a spacing $S_1$. The spacing $S_1$ may be sized so that a differential pair of signal conductors may be positioned between the adjacent ground contacts 228. The ground termination component 300 includes a top surface 312 and a bottom surface 314 that face in opposite directions. The thickness $T_1$ is measured between the top and bottom surfaces 312, 314. In the illustrated embodiment, the thickness $T_1$ is substantially uniform, but may have varying sizes in other embodiments. As shown in FIG. 4, the main panel 304 may be positioned adjacent to the communication cables 230 such that the upper surface 312 along the main panel 304 interfaces with the lower planar side 244 of the communication cable 230.

The main panel 304 includes a plurality of strain relief elements 310 integral with and extending from the main panel 304, each being engaged with at least a portion of interface 302 (FIG. 3) of corresponding communication cables 230 to confine the communication cables 230 in one or more directions and provide strain relief to the communication cables 230, such as during assembly of the electrical assembly 200. In the exemplary embodiment, each strain relief element 310 has a substantially hook shaped mating tab with a substantially vertical proximate end 320 connected to the main panel 304 and a substantially horizontal connective terminal 330 (FIG. 3) configured to electrically couple with the grounding element 236 through the access opening 250.

Each connective terminal 330 is mechanically and/or electrically coupled to the grounding elements 236 to provide electrical coupling between the ground termination component 300 and the communication cables 230. In an exemplary embodiment, each connective terminal 330 is substantially rectangular tab aligned with corresponding access opening 250. However, the connective terminals 330 can be configured in any shape and size to provide for electrical and mechanical coupling between the ground termination component 300 and the communication cables 230. Each connective terminal 330 may be dimensioned to permit a conductive binding material to join the connective terminal to the grounding element 236 through the access opening 250. In other embodiments, a different conductive binding material may be used. For example, the conductive binding material may be an adhesive, epoxy, foam, tape, or the like.

In other embodiments, the connective terminals 330 may have other configurations to mechanically and electrically couple the ground termination component 206 with the grounding elements 236, including, but not limited to, a single tab, or an insulation displacement connector. In addition, the connective terminals 330 can be configured to couple with the grounding element 236 with an interference or pinch fit.

Each ground termination component 300 may be a single continuous piece of material. For example, the ground termination component 300 may be stamped and formed from sheet metal or may be molded or cast using a conductive material. Although one ground termination component 300 is shown in the illustrated embodiment, alternate embodiments of the electrical assembly 200 may include additional ground termination components 300. For example, a second ground termination component (not shown) may electrically coupled between electrical contacts (not shown) and communication cable along the bottom board surface 220. Optionally, the ground termination component 300 may be separated into multiple portions. For example, the ground termination component may include multiple discrete panels each having one or more strain relief elements to engage with corresponding communication cables.

As shown in FIG. 4, pairs of strain relief elements 310 are distributed along a width $W_1$ of the ground termination component 300 by a spacing $S_2$. Each pair of strain relief elements 310 include a first strain relief element 331 having a first proximate end 334 attached to the main panel 304, and a second strain relief element 332 having a second proximate end 336 attached to the main panel 304. The first and second proximate ends 334, 336 are positioned adjacent to and substantially coplanar with each other. The connection terminals 330 of the first and second strain relief elements 332, 334 extend in substantially planar and opposite directions to align with corresponding access openings 250 and electrically couple with corresponding grounding elements 236 (FIG. 3).

Although the strain relief elements 310 are shown to partially circumferentially surround at least two sides, such as one of the contoured sides 241, 242 and the planar side 244, of the first communication cable, any portion and/or number of sides can be surrounded.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical device, comprising:

a substrate having a plurality of signal contacts and a ground contact along a surface of the substrate;

a communication cable including a differential pair of signal conductors, a grounding element that surrounds the signal conductors, and a cable jacket surrounding the signal conductors and the grounding element; wherein each of the signal conductors has a wire-terminating end that is terminated to a corresponding signal contact of the substrate, the wire-terminating end projecting beyond a jacket edge of the cable jacket; and a ground termination component having a main panel electrically coupled with the ground contact, and a strain relief element engaged with at least a portion of the communication cable; wherein the strain relief element includes a connective terminal electrically coupled to the grounding element.

2. The electrical device of claim 1, wherein the strain relief element includes a mating tab coupled to and at least partially circumferentially surrounding an outer portion of the communication cable.

3. The electrical device of claim 1, wherein the main panel extends along the surface of the substrate, the strain relief element extending from the main panel away from the surface along the communication cable.

4. The electrical device of claim 1, wherein the strain relief element is a first strain relief element including a first proximate end attached to the main panel; the ground termination component further including a second strain relief element having a second proximate end connected to the main panel and positioned adjacent to and substantially coplanar with the first proximate end of the first strain relief element.

5. The electrical device of claim 4, wherein the first strain relief element and the second strain relief element extend from the main panel between the communication cable and a second communication cable, the first strain relief element engaging the communication and the second strain relief element engaging the second communication cable.

6. The electrical device of claim 1, wherein, the cable jacket has an access opening being located a longitudinal distance from the jacket edge of the cable jacket;

wherein the connective terminal is electrically coupled to the grounding element through the access opening.

7. The electrical device of claim 6, further comprising a conductive binding material located within the access opening that electrically couples the connective terminal to the grounding element.

8. The electrical device of claim 1, further comprising:

a second communication cable including a differential pair of signal conductors, a grounding element that surrounds the signal conductors, and a cable jacket surrounding the signal conductors and the grounding element; wherein each of the signal conductors has a wire-terminating end that is terminated to a corresponding signal contact of the substrate, the wire-terminating end projecting beyond a jacket edge of the cable jacket;

wherein the ground termination component further comprises a second strain relief element engaged with at least a portion of the second communication cable, wherein the second strain relief element includes a second connective terminal electrically couple to a second grounding element of the second communication cable.

9. An electrical device, comprising:

a substrate having a plurality of signal contacts and a ground contact along a surface of the substrate;

a communication cable including a differential pair of signal conductors, a grounding element that surrounds the signal conductors, and a cable jacket surrounding the signal conductors and grounding element; wherein each of the signal conductors has a wire-terminating end that is terminated to a corresponding signal contact of the substrate, the wire-terminating end projecting beyond a jacket edge of the cable jacket; the cable jacket having an access opening being located a longitudinal distance from the jacket edge of the cable jacket; and a ground termination component having a main panel electrically coupled with the ground contact, and a strain relief element engaged with at least a portion of the communication cable, wherein the strain relief element includes a connective terminal electrically coupled to the grounding element through the access opening.

10. The electrical device of claim 9, wherein the strain relief element includes a mating tab coupled to and at least partially circumferentially surrounding an outer portion of the communication cable.

11. The electrical device of claim 9, wherein the main panel extends along the surface of the substrate, the strain relief element extending from the main panel away from the surface along the communication cable.

12. The electrical device of claim 9, wherein the strain relief element is a first strain relief element including a first proximate end attached to the main panel; the ground termination component further including a second strain relief element having a second proximate end connected to the main panel and positioned adjacent to and substantially coplanar with the first proximate end of the first strain relief element.

13. The electrical device of claim 12, wherein the first strain relief element and the second strain relief element extend from the main panel between the communication cable and a second communication cable, the first strain relief element engaging the communication and the second strain relief element engaging the second communication cable.

14. The electrical device of claim 9, further comprising a conductive binding material located within the access opening that electrically couples the connective terminal to the grounding element.

15. The electrical device of claim 9, further comprising:

a second communication cable including a differential pair of signal conductors, a grounding element that surrounds the signal conductors, and a cable jacket surrounding the signal conductors and the grounding element; wherein each of the signal conductors has a wire-terminating end that is terminated to a corresponding signal contact of the substrate, the wire-terminating end projecting beyond a jacket edge of the cable jacket;

wherein the ground termination component further comprises a second strain relief element engaged with at least a portion of the second communication cable, wherein the second strain relief element includes a second connective terminal electrically couple to a second grounding element of the second communication cable.

16. An electrical device, comprising:

a substrate having a plurality of signal contacts and a ground contact along a surface of the substrate;

a first communication cable including a differential pair of signal conductors, a grounding element that surrounds the signal conductors, and a cable jacket surrounding the signal conductors and the grounding element; wherein each of the signal conductors has a wire-terminating end that is terminated to a corresponding signal contact of the substrate, the wire-terminating end projecting beyond a jacket edge of the cable jacket;

a second communication cable including a differential pair of signal conductors, a grounding element that surrounds the signal conductors, and a cable jacket surrounding the signal conductors and the grounding element; wherein each of the signal conductors has a wire-terminating end that is terminated to a corresponding signal contact of the substrate, the wire-terminating end projecting beyond a jacket edge of the cable jacket; and a ground termination component electrically coupled with the ground contact, and having a first strain relief element configured to engage with at least a portion of the first communication cable, and a second strain relief element configured to engage with at least a portion of the second communication cable;

wherein the first strain relief element includes a first connective terminal electrically coupled to the grounding element of the first communication cable, and the second strain relief element includes a second connective terminal electrically coupled to the grounding element of the second communication cable.

17. The electrical device of claim 16, wherein the ground termination component includes a main panel, the first strain relief element extending from the main panel and having a first connective terminal electrically connected to the grounding element of first communication cable, and the second strain relief element extending from the main panel and having a second connective terminal electrically connected to the grounding element of the second communication cable.

18. The electrical device of claim 16, wherein the first strain relief element includes a first proximate end attached to the main panel; and the second strain relief element includes a second proximate end attached to the main panel and positioned adjacent to and substantially coplanar with the first proximate end of the first strain relief element.

19. The electrical device of claim 16, where the first strain relief element is configured to confine the first communication cable in one or more directions.

20. The electrical device of claim 16, wherein the first strain relief element is a hook at least partially circumferentially surrounding at least two sides of the first communication cable.

* * * * *